US007090110B2

(12) United States Patent
Adams et al.

(10) Patent No.: US 7,090,110 B2
(45) Date of Patent: Aug. 15, 2006

(54) PAPER LOCATOR FOR A STAPLER

(75) Inventors: David P. Adams, Barrington, IL (US); Roland Sudmalis, Chicago, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 10/896,480

(22) Filed: Jul. 21, 2004

(65) Prior Publication Data

US 2005/0017051 A1 Jan. 27, 2005

Related U.S. Application Data

(60) Provisional application No. 60/489,367, filed on Jul. 23, 2003.

(51) Int. Cl.
*B25C 5/00* (2006.01)
*B25C 5/11* (2006.01)

(52) U.S. Cl. ..... 227/120; 227/140; 227/151; 227/154

(58) Field of Classification Search ..... 227/61, 227/120, 134, 140, 151, 154
See application file for complete search history.

(56) References Cited

U.S. PATENT DOCUMENTS

| | | | | |
|---|---|---|---|---|
| 2,073,958 | A | 3/1937 | Crosby | |
| 2,900,638 | A | 8/1959 | O'Kelley | |
| 3,209,976 | A | 10/1965 | Vogel | |
| 3,266,699 | A | 8/1966 | Vogel | |
| 3,282,489 | A | 11/1966 | March | |
| 3,523,634 | A | 8/1970 | Olney et al. | |
| 3,630,428 | A * | 12/1971 | Olney et al. | 227/128 |
| 4,831,722 | A | 5/1989 | Bauer et al. | |
| D310,950 | S | 10/1990 | Olesen et al. | |
| 4,988,029 | A | 1/1991 | Fiske | |
| 5,094,379 | A | 3/1992 | Hoyer et al. | |
| 5,509,595 | A * | 4/1996 | Ho | 227/119 |
| 5,595,336 | A | 1/1997 | Everdyke | |
| 5,692,666 | A | 12/1997 | Dallas | |
| 5,692,667 | A * | 12/1997 | Chi | 227/151 |
| 5,791,544 | A | 8/1998 | Fujimaki | |
| 5,803,337 | A | 9/1998 | Fukai et al. | |
| 5,842,624 | A | 12/1998 | Ishida | |
| 6,079,706 | A | 6/2000 | Hashem | |
| 6,164,511 | A * | 12/2000 | Chung et al. | 270/58.08 |
| 6,173,949 | B1 | 1/2001 | Visick et al. | |

(Continued)

FOREIGN PATENT DOCUMENTS

| | | |
|---|---|---|
| DE | 4108949 | 3/1991 |

(Continued)

*Primary Examiner*—Scott A. Smith
*Assistant Examiner*—Gloria R. Weeks
(74) *Attorney, Agent, or Firm*—Michael Best & Friedrich LLP

(57) ABSTRACT

A stapler for binding a stack of sheets includes a base, a staple driving mechanism coupled to the base, and a sheet locating device coupled to the base. The sheet locating device includes a guide having first and second guide members and is movable with respect to the staple driving mechanism from a first rotational orientation relative to the staple driving mechanism to a second rotational orientation. The stapler can be used to perform a method of stapling wherein a first stack of sheets receives a staple in a first rotational orientation with respect to the guide, and a second stack of sheets receives a staple in a second rotational orientation with respect to the guide by moving the guide between first and second rotational orientations.

47 Claims, 5 Drawing Sheets

U.S. PATENT DOCUMENTS

| | | | | |
|---|---|---|---|---|
| 6,199,852 | B1 | 3/2001 | Visick et al. | |
| D447,396 | S | 9/2001 | Arns | |
| 6,676,002 | B1 * | 1/2004 | Jairam et al. | 227/154 |
| 2001/0013530 | A1 | 8/2001 | Raffoni | |
| 2003/0110917 | A1 | 6/2003 | Arnold | |
| 2003/0178464 | A1 * | 9/2003 | Sinisi et al. | 227/134 |
| 2005/0167467 | A1 * | 8/2005 | Sprich | 227/151 |
| 2006/0016848 | A1 | 1/2006 | Basti | |

FOREIGN PATENT DOCUMENTS

| | | |
|---|---|---|
| GB | 2229129 | 3/1989 |
| GB | 2225271 | 5/1990 |
| WO | WO 98/33627 | 8/1998 |
| WO | WO 03/070430 | 8/2003 |

* cited by examiner

PAPER LOCATOR FOR A STAPLER

RELATED APPLICATIONS

This application claims the benefit of priority to U.S. Provisional Patent Application No. 60/489,367, filed Jul. 23, 2003, the contents of which are incorporated by reference herein.

FIELD OF THE INVENTION

The invention relates to staplers, and more particularly to devices for locating paper within a stapler.

BACKGROUND OF THE INVENTION

Staplers, both manual and electric, are used to impart a staple to bind together a stack of sheets, such as sheets of paper. It is often desirable to maneuver the orientation of the stack of paper within the stapler to vary the orientation of the staple with respect to the stack of papers. Currently-used staplers, electric staplers in particular, make it difficult for the user to control the orientation of the staple with respect to the stack of papers as it is difficult for the user to determine when and where the placement of the stack of papers within the electric stapler will trigger the staple driving mechanism.

SUMMARY OF THE INVENTION

The present invention provides an improved device and method for locating or orienting a stack of papers within a stapler. More specifically, the invention provides a stapler having a base, a staple driving mechanism coupled to the base, and a sheet locating device coupled to the base. The sheet locating device includes a guide having a first guide member configured to receive a first edge of the stack of sheets and a second guide member configured to receive a second edge of the stack of sheets. The sheet locating device is movable with respect to the staple driving mechanism from a first rotational orientation relative to the staple driving mechanism to a second rotational orientation. This allows a staple to be driven from the staple driving mechanism in at least two different rotational orientations relative to the stack of sheets. The first and second guide members each have a guide surface, and the guide surfaces are fixed relative to each other.

In one embodiment of the invention, the stapler includes an anvil. The anvil can be coupled to the sheet locating device such that the anvil is movable with the sheet locating device and includes a plurality of staple receiving portions. In another embodiment, the guide surfaces are substantially normal to each other. In another embodiment, the first and second guide members are elongated such that the first and second guide members are greater than a crown width of the staples driven by the staple driving mechanism.

The above-described apparatus can also be used to perform a method of stapling using a stapler, the stapler having a staple driving mechanism, a base, and a movable guide. The method includes positioning the guide in a first rotational position relative to the staple driving mechanism, inserting a first stack of sheets into contact with the guide, actuating the staple driving mechanism to insert a staple into the stack of sheets in a first rotational orientation relative to the guide, and removing the first stack of sheets. The method further includes moving the guide to a second rotational position relative to the staple driving mechanism, inserting a second stack of sheets into contact with the guide, and actuating the staple driving mechanism to insert a staple into the second stack of sheets in a second rotational orientation relative to the guide. Moving the guide to the second rotational position causes simultaneous motion of both the first and second guide members in the same rotational direction.

Other features and advantages of the invention will become apparent to those skilled in the art upon review of the following detailed description, claims, and drawings.

Figure 1:
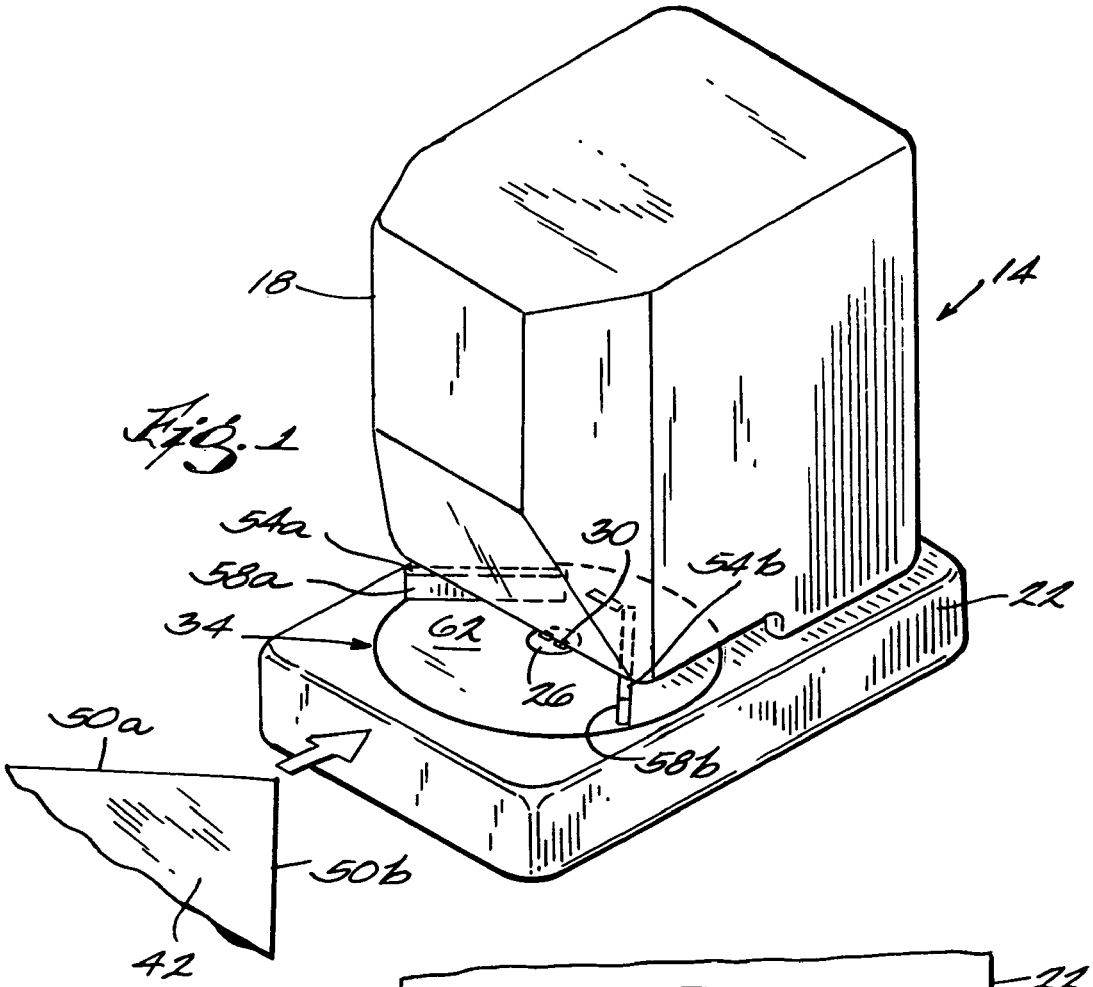
FIG. 1 is a perspective view of a stapler having a sheet locating device embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" "having," and "comprising" and variations thereof herein is meant to encompass the items listed thereafter and equivalents thereof as well as additional items.

DETAILED DESCRIPTION

FIGS. 1–6 illustrate a first embodiment of the present invention. The stapler 14 illustrated in FIG. 1 is an electric stapler, but it is understood that the stapler 14 could be any type of stapler, such as a manually actuated stapler. The stapler 14 includes a staple driving mechanism, indicated generally by the reference numeral 18, coupled to a base 22.

Figure 2:
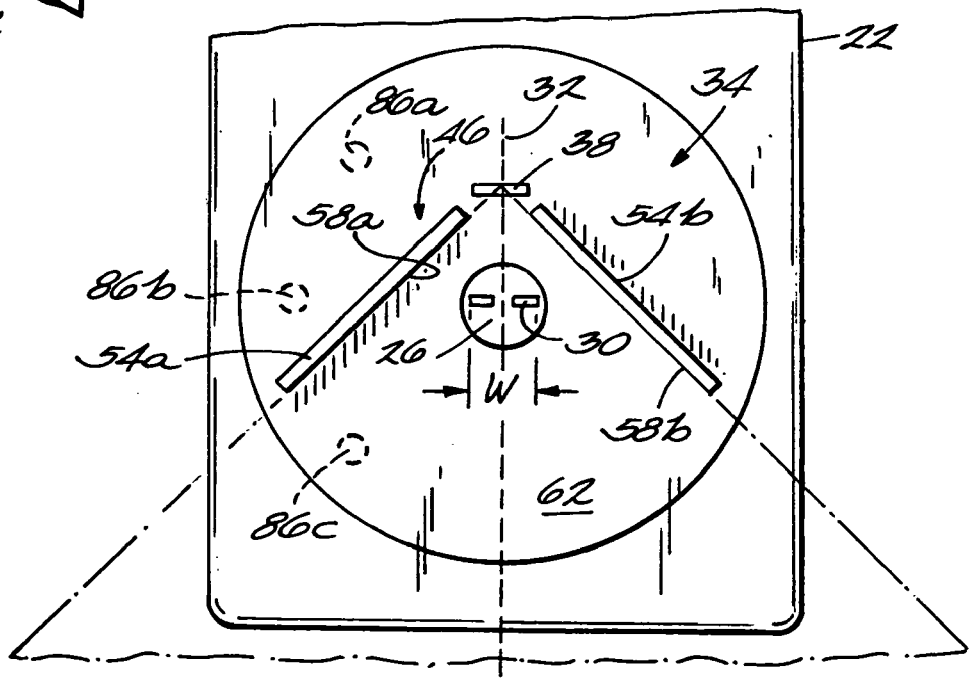
FIG. 2 is a top view of the sheet locating device of FIG. 1.

Those skilled in the art will understand that any suitable mechanism capable of driving a staple can be used. The base 22 includes an anvil 26 having a staple receiving portion 30, as illustrated in FIGS. 1 and 2. The base 22 also includes a longitudinal axis 32, best illustrated in FIG. 2.

A sheet locating device 34 is also coupled to the base 22. As illustrated in FIG. 1, the sheet locating device 34 is inset into the top surface of the base 22. The sheet locating device 34 includes a sensor 38, best shown in FIG. 2, for detecting the placement of a stack of sheets 42 within the stapler 14. In the illustrated embodiment, the sensor 38 is a photoelectric eye. In other embodiments, the sensor could be a resilient tab or other means of triggering the staple driving mechanism. Alternatively, the stapler 14 could require independent manual stapling actuation.

In other embodiments, the sensor 38 could be positioned in the base 22 of the stapler 14. In those embodiments, the sheet locating device 34 would cooperate with the sensor 38 in the base 22 to allow the sensor 38 to trigger the staple driving mechanism 18 when a stack of sheets 42 is introduced. In some embodiments, such as the embodiment shown in FIGS. 1–6, the sheet locating device 34 also cooperates with the anvil 26 in the stapler base 22, as will be discussed in greater detail below.

The sheet locating device 34 includes a guide 46 for receiving an edge 50 of a stack of sheets 42, such as a stack of papers. As illustrated in FIGS. 1–6, the guide 46 includes a pair of guide members 54*a*, 54*b* having guide surfaces 58*a*, 58*b* that receive adjacent edges 50*a*, 50*b* of a stack of sheets 42. The guide surfaces 58*a*, 58*b* are substantially straight to properly position the respective edges 50*a*, 50*b* of the stack of sheets 42. In the illustrated embodiment, the guide surfaces 58*a*, 58*b* form a 90° angle with respect to each other to receive the adjacent edges 50*a*, 50*b* of a stack of sheets 42.

In the illustrated embodiment, the guide 46 extends from and is supported by a substantially planar support surface 62 defined by a body portion 64 of the sheet locating device 34. While the guide 46 is illustrated as being integrally formed with the body portion 64, it is understood that the guide 46 could also be one or more separate parts coupled to the support surface 62.

Figure 3:
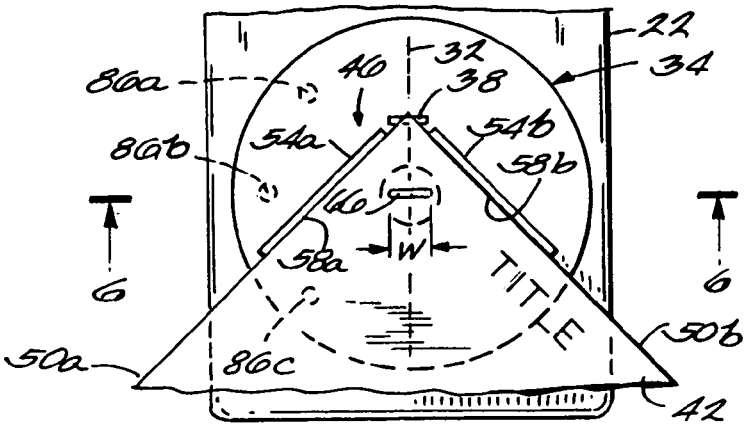
FIG. 3 is a top view of a first rotational orientation of the sheet locating device of FIG. 1.
Figure 4:
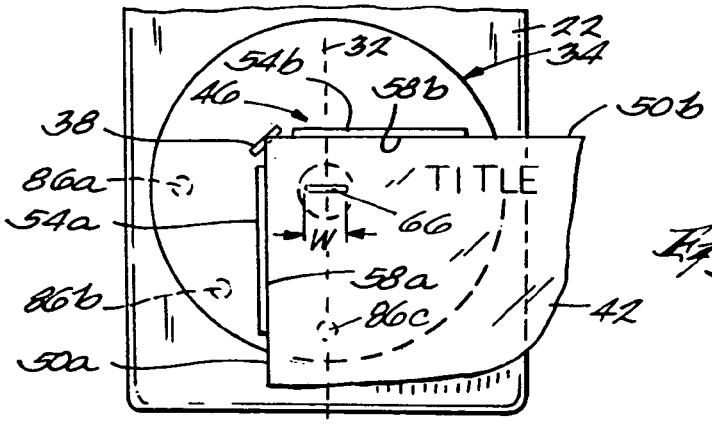
FIG. 4 is a top view of a second rotational orientation of the sheet locating device of FIG. 1.
Figure 5:
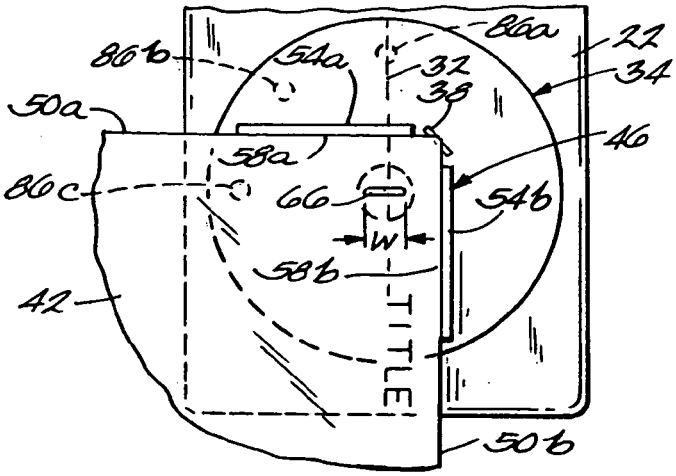
FIG. 5 is top view of a third rotational orientation of the sheet locating device of FIG. 1.

A staple 66 is driven by the stapler 14 and has a crown width W illustrated in FIGS. 2–5. The guide members 54*a*, 54*b* and the guide surfaces 58*a*, 58*b* are elongated to contact the edges 50*a*, 50*b* of the stack of sheets 42 along a portion of the edges 50*a*, 50*b* greater than or equal in length to at least one crown width W of the staple 66. In some constructions, the guide members 54*a*, 54*b* have a length greater than about two crown widths W of the staple 66. In other constructions, the guide members 54*a*, 54*b* have a length greater than about three crown widths W of the staple 66. Such a construction is illustrated in FIGS. 3–5.

With further reference to FIGS. 3–5, the sheet locating device 34 is mounted for movement with respect to the staple driving mechanism 18. The sheet locating device 34 is movable from a first orientation relative to the staple driving mechanism 18 to a second orientation relative to the staple driving mechanism 18 such that when moving between the first and second orientations, portions of the guide 46 undergo movement in a direction having a component substantially parallel to the longitudinal axis 32 and a component substantially normal to the longitudinal axis 32. In the illustrated embodiments, that movement is rotation that occurs in a plane generally normal to the staple driving direction, and the sheet locating device 34 is movable between different rotational orientations relative to the staple driving mechanism 18.

The guide surfaces 58*a*, 58*b* are fixed relative to each other such that moving the sheet locating device 34 causes simultaneous motion of both the first and second guide surfaces 58*a*, 58*b* in the same rotational direction. The movement of the sheet locating device 34 allows a user to position the sheet locating device 34 so that the staple driving mechanism 18 is able to drive staples 66 into a stack of sheets 42 in multiple rotational staple orientations with respect to the guide 46, and ultimately with respect to the stack of sheets 42. FIGS. 1–3 show a first rotational orientation of the sheet locating device 34 relative to the staple driving mechanism 18. The sheets 42 are inserted into the sheet locating device 34 to receive the staple 66 in a first rotational orientation. In this case, the first rotational orientation of the staple 66 is oblique to both of the guide surfaces 58*a*, 58*b* and the corresponding sheet edges 50*a*, 50*b*.

FIG. 4 illustrates a second rotational orientation of the sheet locating device 34 relative to the staple driving mechanism 18. In this configuration, the staple 66 is inserted into the sheets 42 in a second rotational orientation, with the staple 66 being generally perpendicular to the first guide surface 58*a* and the edge 50*a*. In this second rotational orientation, the staple 66 is also generally parallel to the second guide surface 58*b* and the edge 50*b*.

FIG. 5 illustrates a third rotational orientation of the sheet locating device 34 relative to the staple driving mechanism 18 and a corresponding third rotational orientation of the staple 66. In the third rotational orientation, the staple 66 is generally parallel to the first guide surface 58*a* and the edge 50*a*. In this third rotational orientation, the staple 66 is also generally perpendicular to the second guide surface 58*b* and the edge 50*b*. It is understood, however, that these three staple orientations are merely examples of possible orientations and that many other staple orientations are possible and still fall within the scope of the present invention.

In the embodiment illustrated in FIG. 1, the sheet locating device 34 can be rotated manually by grasping a portion of one or both of the guide members 54*a*, 54*b* and rotating the sheet locating device 34 with respect to the staple driving mechanism 18. It is understood that in this and other embodiments not shown, the sheet locating device 34 may also be rotated by moving a lever 70 (shown in phantom in FIG. 6), pushing a button, or by other means.

Figure 6:
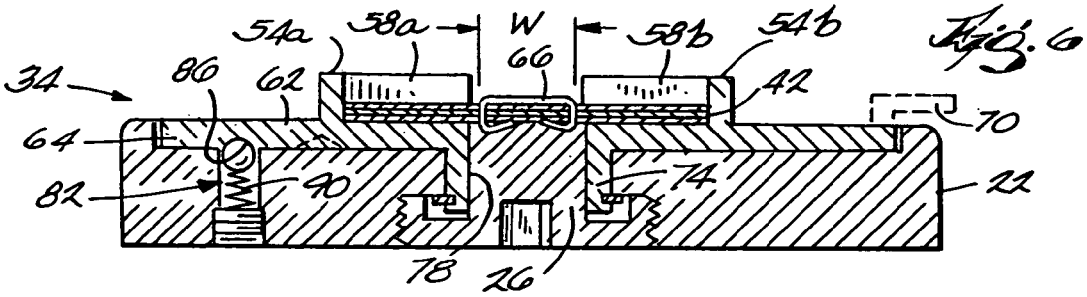
FIG. 6 is a section view taken along line 6—6 of FIG. 3.

As best shown in FIG. 6, the anvil 26 remains fixed within the base 22. The sheet locating device 34 is provided with a shaft 74 having a central opening 78 to accommodate the anvil 26, and the sheet locating device 34 rotates around the anvil 26. Thus, the staple receiving portion 30 of the anvil 26 remains fixed relative to the staple driving mechanism 18, thereby providing for proper staple clinching regardless of the rotational orientation of the sheet locating device 34. Those skilled in the art will understand that while not shown, a bearing or similar device for facilitating relative rotation between the shaft 74 and the anvil 26 can be positioned in the base 22 to receive the shaft 74.

With further reference to FIG. 6, the illustrated sheet locating device 34 also includes a detent mechanism 82 positioned between the sheet locating device 34 and the base 22 of the stapler 14 to hold the sheet locating device 34 in the desired position. The detent mechanism 82 operates as a locking mechanism such that the sheet locating device 34 is substantially immovable in response to insertion and engagement of the stack of sheets 42 with the guide 46. The detent mechanism 82 includes a plurality of detents 86 on the underside of the sheet locating device 34 corresponding to the predetermined rotational positions of the sheet locating device 34, and a ball and spring mechanism 90 that cooperates with the detents 86 to hold the sheet locating device 34 in the desired position. If the user desires to move the sheet locating device 34 to a different rotational orientation, the user rotates the sheet locating device 34 toward the desired position. The initial force of the rotation deflects the ball 90 from within the current detent 86 to allow the sheet locating device 34 to turn to the appropriate position, in which the ball 90 will be received in a new detent 86.

In the illustrated embodiment, the sheet locating device 34 includes three detents 86*a*, 86*b*, 86*c*, however any number of detents can be used. It is understood that in other embodiments, the ball and spring mechanism 90 could be mounted to the underside of the sheet locating device 34 and the detent 86 could be formed in the base 22. Additionally, other suitable mechanisms could be substituted for the illustrated detent mechanism 82.

To use the above-described stapler 14 and sheet locating device 34, a user positions the guide 46 of the sheet locating device 34 in a first desired rotational position relative to the staple driving mechanism 18. The user then inserts a first stack of sheets 42 into the stapler 14, aligning the edges 50*a*, 50*b* of the sheets 42 with the respective guide surfaces 58*a*, 58*b* and actuating the staple driving mechanism 18. A staple 66 is inserted into the first stack of sheets 42 in a first rotational orientation relative to the guide 46 and to the first stack of sheets 42. The user can then remove the first stack of sheets 42 and move the guide 46 to a second rotational position relative to the staple driving mechanism 18. The user then inserts a second stack of sheets 42 within the stapler 14 as described above and actuates the staple driving mechanism 18 again. A staple 66 is inserted into the second stack of sheets 42 in a second rotational orientation relative to the guide 46 and to the second stack of sheets 42. Thus, the first and second stacks of sheets 42 are stapled with different staple orientations.

FIGS. 7–11 illustrate a second embodiment of the present invention. Like parts are given like reference numerals. Similar parts are designated as prime (′). In the embodiment illustrated in FIGS. 7–11, the sheet locating device 34′ is coupled to and supported above the top of the base 22′. The sheet locating device 34′ can be manually rotated by grasping the outer edge 94 of the sheet locating device 34′ and rotating the sheet locating device 34′ with respect to the staple driving mechanism 18 and the base 22′. The outer edge 94 can include ridges or other features (not shown) that facilitate grasping. It is understood that in this and other embodiments not shown, the sheet locating device 34′ may also be rotated by moving a lever (similar to the lever 70 shown in phantom in FIG. 6), pushing a button, or by other means.

The sheet locating device 34′ is coupled to the base 22′ by inserting a post 98 that extends from the underside of the sheet locating device 34′ into an aperture 102 in the base 22′ of the stapler 14′. Those skilled in the art will understand that while not shown, a bearing or similar device for facilitating relative rotation between the post 98 and the base 22′ can be positioned in the aperture 102 to receive the post 98.

Figure 7:
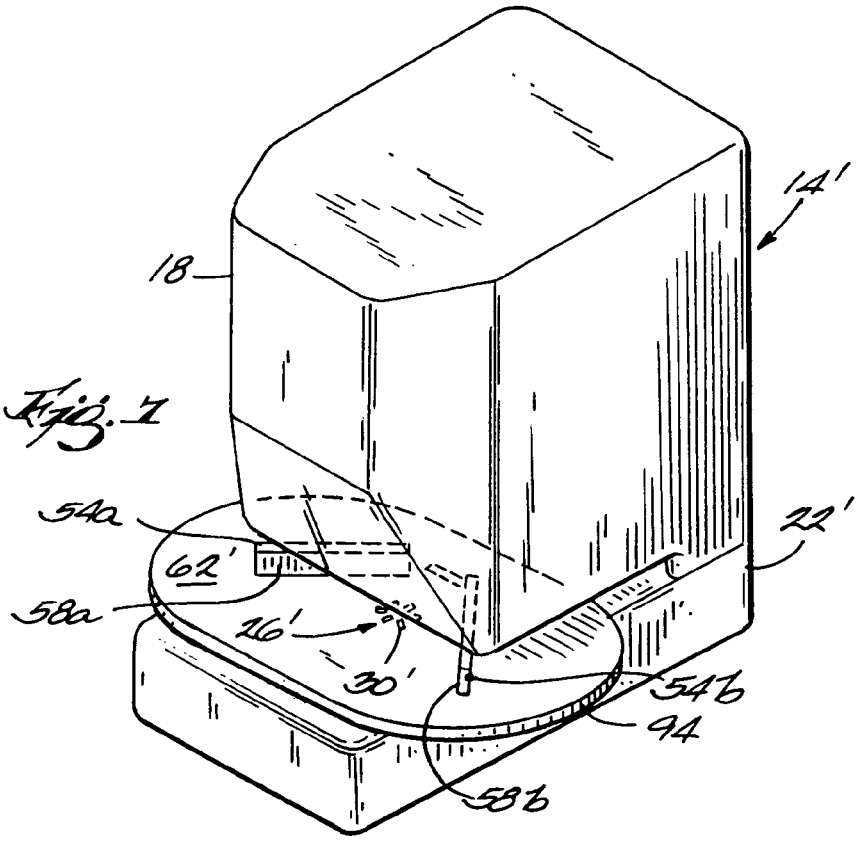
FIG. 7 is a perspective view of a stapler having a sheet locating device according to another embodiment of the present invention.
Figure 11:
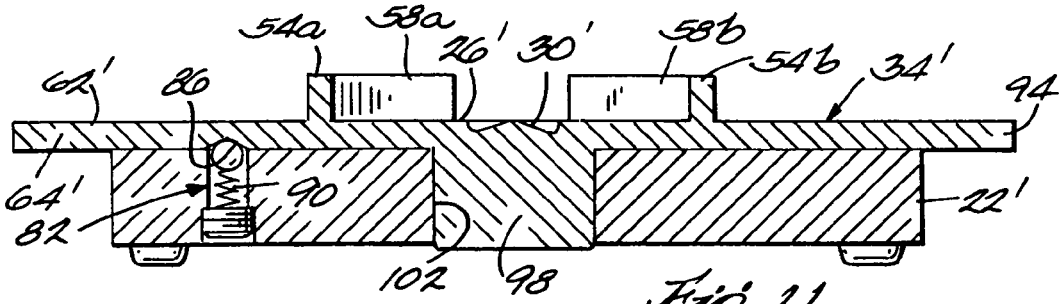
FIG. 11 is a section view taken along line 11—11 of FIG. 8 illustrating an anvil integrally formed with the sheet locating device.
Figure 8:
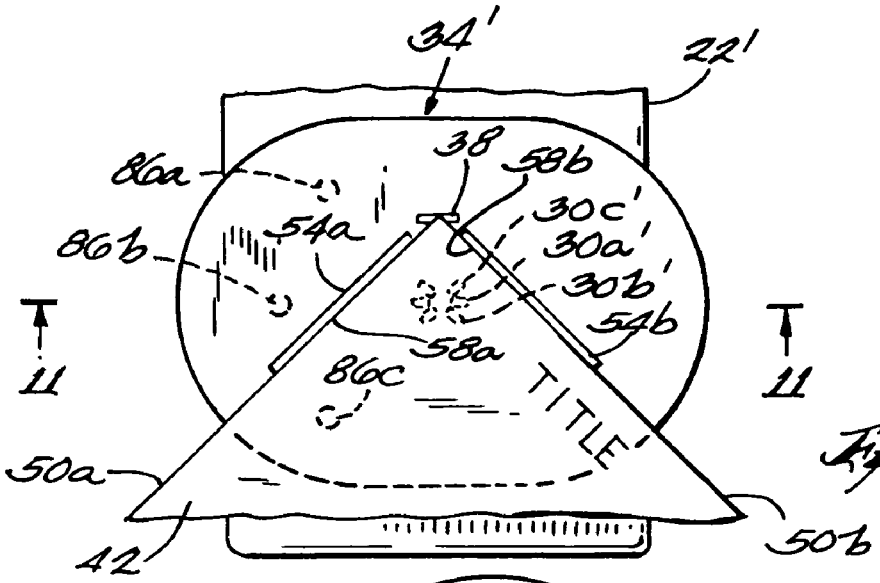
FIG. 8 is a top view of a first rotational orientation of the sheet locating device of FIG. 7, wherein a first staple receiving portion is utilized for staple clinching.
Figure 9:
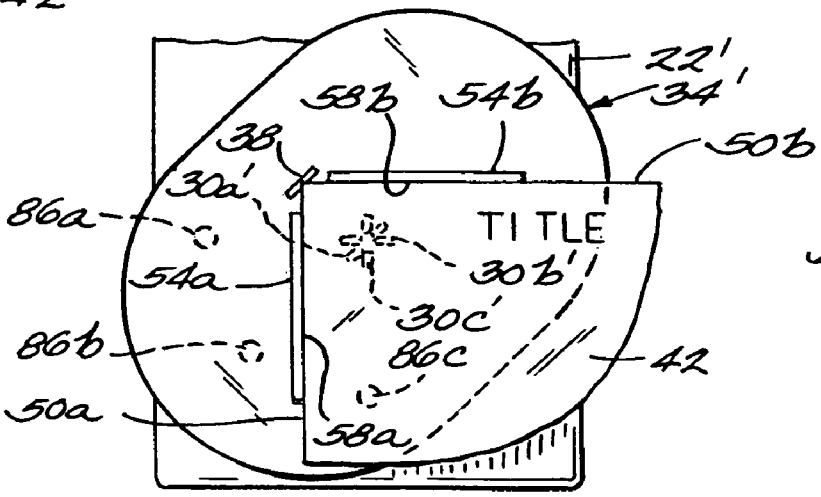
FIG. 9 is a top view of a second rotational orientation of the sheet locating device of FIG. 7, wherein a second staple receiving portion is utilized for staple clinching.
Figure 10:
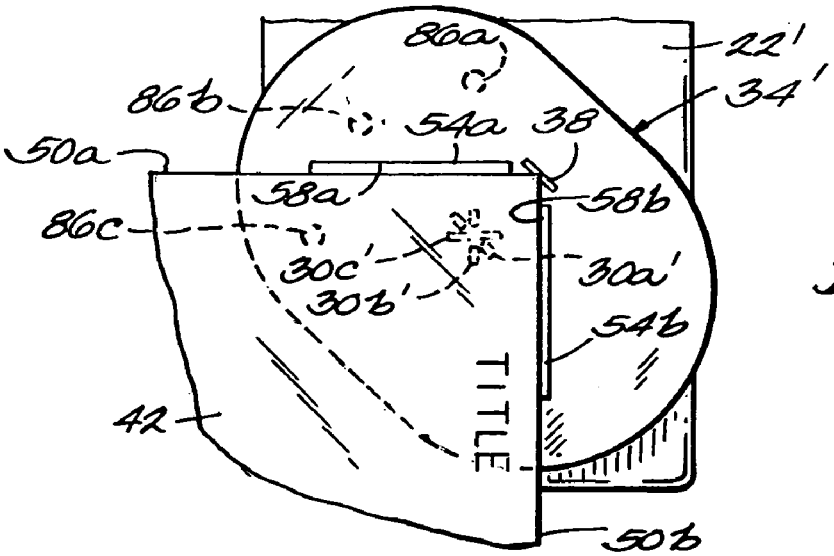
FIG. 10 is a top view of a third rotational orientation of the sheet locating device of FIG. 7, wherein a third staple receiving portion is utilized for staple clinching.

With reference to FIG. 7, the anvil 26′ is integrally formed with the sheet locating device 34′. In this embodiment, the anvil 26′ rotates with the sheet locating device 34′ and thus the staple receiving portion 30′ rotates as well. To ensure proper clinching in each of the desired rotational orientations, multiple staple receiving portions 30′ are provided. As illustrated in FIGS. 8–10, three anvil staple receiving portions 30*a*′, 30*b*′, 30*c*′ are provided to ensure that the staple 66 is properly clinched in each of the three rotational orientations described below with respect to FIGS. 8–10.

In FIG. 8, staple receiving portion 30*a*′ is utilized to produce the oblique staple orientation previously described above with respect to FIG. 3. In the rotational orientation of FIG. 9, staple receiving portion 30*b*′ is utilized to produce the staple orientation previously described above with respect to FIG. 4. In the rotational orientation of FIG. 10, staple receiving portion 30*c*′ is utilized to produce the staple orientation previously described above with respect to FIG. 5. Of course, it is understood by one of skill in the art that additional staple receiving portions may be provided if additional rotational staple orientations are desired. Alternatively, an anvil with a dimple-shaped staple receiving portion could be substituted for the anvil 26′. The dimple-shaped staple receiving portion is a concave surface, substantially circular in top view, that is adapted to receive a staple and allow for staple clinching in the various desired staple orientations.

Figure 12:
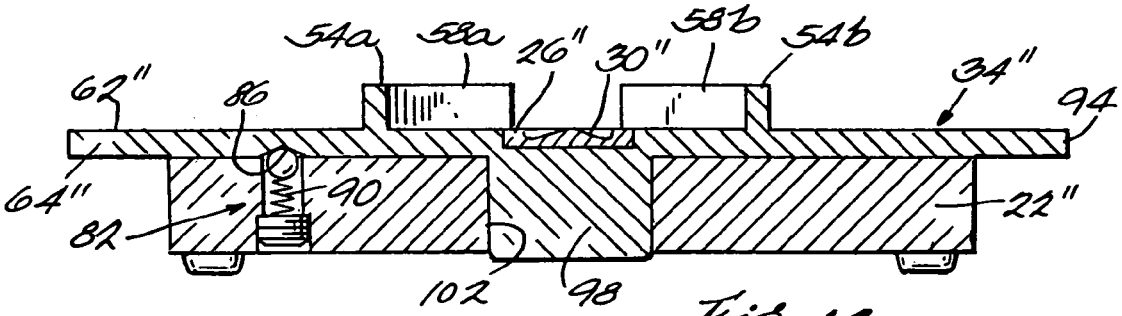
FIG. 12 is a section view similar to FIG. 11 illustrating an alternative design having an anvil inset into the sheet locating device.

FIG. 12 illustrates a third embodiment of the invention. Again, like parts will be given like reference numerals and similar parts will be designated as double prime (″). As illustrated in FIG. 12, the anvil 26″ is an insert that is inset into the top surface, i.e., the sheet support surface 62″, of the sheet locating device 34″. With this embodiment, the anvil 26″ can be formed of a different material than the sheet locating device 34″. Like the embodiment of FIGS. 7–11, the anvil 26″ rotates with the sheet locating device 34″ and thus includes multiple staple receiving portions (similar to the staple receiving portions 30*a*′, 30*b*′, 30*c*′).

Figure 13:
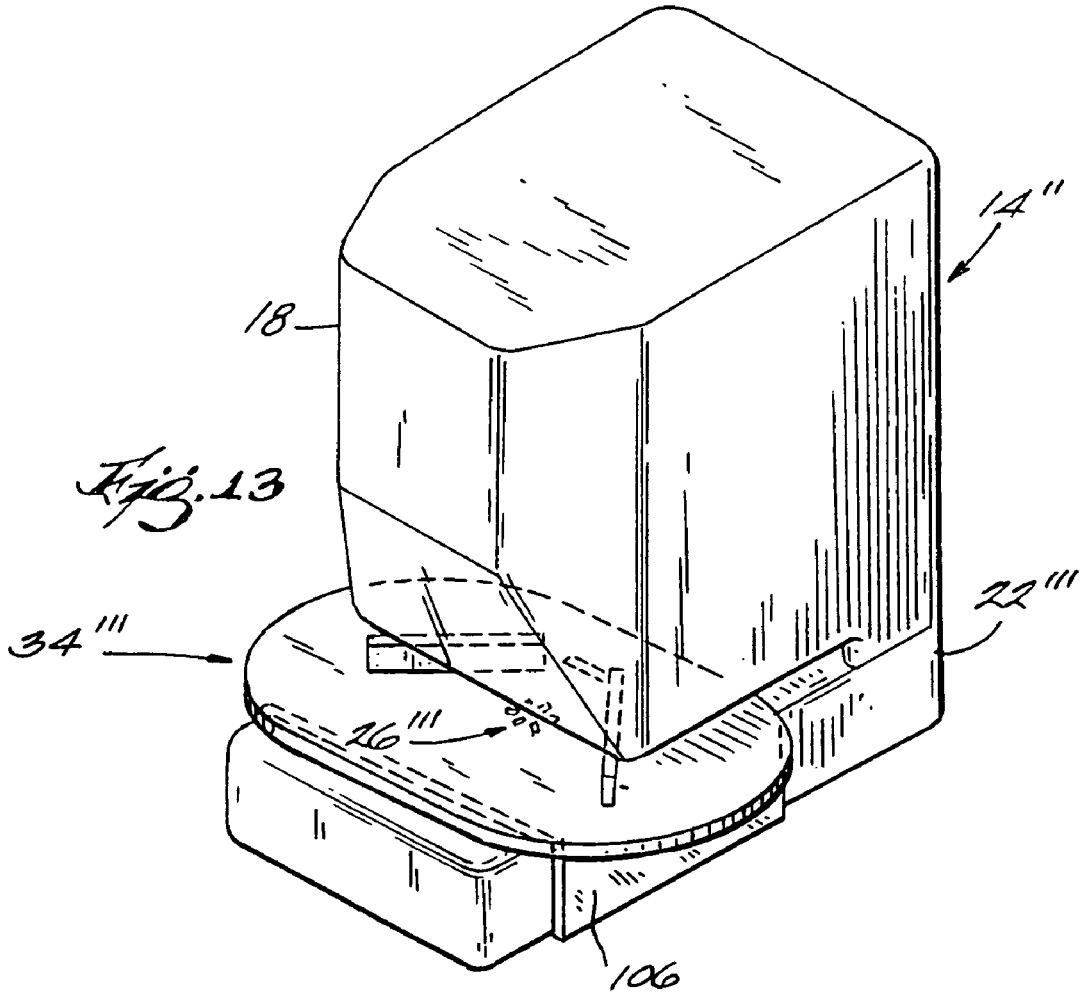
FIG. 13 is a perspective view of a stapler having a sheet locating device according to another embodiment of the present invention.

It is also understood that the sheet locating device of the present invention can be sold separately from a stapler as an aftermarket add-on to a stapler. FIG. 13 illustrates this fourth embodiment of the invention. Again, like parts will be given like reference numerals and similar parts will be designated as triple prime (‴). It is also to be understood that features discussed above with respect to the other embodiments, but that are not discussed specifically below, can be included in this fourth embodiment of the invention.

The sheet locating device 34‴ includes a mounting bracket or frame 106 configured to be secured on the base 22‴ of a stapler 14‴. The sheet locating device 34‴ can therefore be secured to the base 22‴ by sliding the mounting bracket 106 onto and over the base 22‴, and/or by clipping or otherwise coupling the mounting bracket 106 around the sides and/or bottom of the base 22‴. The mounting bracket 106 can be configured to cooperate with staplers having different base sizes and configurations.

In the illustrated embodiment, the mounting bracket 106 remains fixed with respect to the staple driving mechanism 18 and the base 22‴, while the remainder of the sheet locating device 34‴ is rotatable with respect to the mounting bracket 106 to provide the different rotational orientations described above. Any suitable mechanisms or devices can be used to provide the relative rotation between the mounting bracket 106 and the remainder of the sheet locating device 34‴. For example, one or more low profile ball bearings can be positioned between the mounting bracket 106 and the remainder of the sheet locating device 34‴. The sheet locating device 34‴ can also include a ball and detent mechanism (similar to the ball and detent mechanism 82) or other suitable device positioned between the mounting bracket 106 and the remainder of the sheet locating device 34‴ to hold the sheet locating device 34‴ in the desired position.

Various features of the invention are set forth in the following claims.

We claim:

1. A stapler for binding a stack of sheets, the stapler comprising:

a base;

a staple driving mechanism coupled to the base; and a sheet locating device coupled to the base, the sheet locating device having a guide member configured to receive a first edge of the stack of sheets, the sheet locating device being movable with respect to the staple driving mechanism from a first rotational orientation relative to the staple driving mechanism to a second rotational orientation relative to the staple driving mechanism such that a staple can be driven from the staple driving mechanism in at least two different orientations relative to the stack of sheets;

wherein the guide member is coupled to the base such that the guide member is movable from the first rotational orientation in response to manipulation by a user, but is substantially immovable from the first rotational orientation in response to contact with the edge of the stack of sheets regardless of orientation of the stack of sheets.

2. The stapler of claim 1, further comprising a locking mechanism that renders the guide member substantially immovable from the first rotational orientation in response to contact with the edge of the stack of sheets.

3. The stapler of claim 2, wherein the locking mechanism is a detent mechanism operatively positioned to retain the sheet locating device in the first rotational orientation during sheet insertion and stapling.

4. The stapler of claim 1, wherein the sheet locating device includes a sheet support surface movable with respect to the base of the stapler, and wherein the guide member is coupled to the sheet support surface.

5. The stapler of claim 1, wherein the sheet locating device is positioned at least partially within the base of the stapler.

6. The stapler of claim 1, wherein the sheet locating device is coupled to a top of the base.

7. The stapler of claim 1, wherein the sheet locating device is movable by grasping and rotating the sheet locating device with respect to the staple driving mechanism.

8. The stapler of claim 1, further comprising a lever coupled to the sheet locating device, and wherein the sheet locating device is movable by actuating the lever.

9. The stapler of claim 1, wherein the sheet locating device includes a central opening such that the sheet locating device is movable around the central opening.

10. The stapler of claim 9, further comprising an anvil, and wherein the anvil is located within the central opening.

11. The stapler of claim 1, further comprising an anvil coupled with the sheet locating device such that the anvil is movable with the sheet locating device.

12. The stapler of claim 11, wherein the anvil is integral with the sheet locating device.

13. The stapler of claim 11, wherein the anvil includes a plurality of staple receiving portions.

14. The stapler of claim 1, wherein the guide member is elongated, and wherein the length of the guide member is greater than a crown width of the staples driven by the staple driving mechanism.

15. The stapler of claim 1, wherein the sheet locating device further includes a second guide member configured to receive a second edge of the stack of sheets, the first and second guide members having respective first and second guide surfaces that are fixed relative to each other.

16. The stapler of claim 15, wherein the first and second guide surfaces are normal to one another.

17. The stapler of claim 15, wherein the second guide member is elongated, and wherein the length of the second guide member is greater than a crown width of the staples driven by the staple driving mechanism.

18. The stapler of claim 1, wherein the sheet locating device rotates in a plane that is generally normal to a staple driving direction.

19. The stapler of claim 1, wherein the sheet locating device is supported by a top surface of the base.

20. The stapler of claim 1, wherein the sheet locating device is irremovably fixed to the base.

21. A sheet locating device for use with a stapler, the sheet locating device comprising:

a guide member configured to receive an edge of a stack of sheets; and a mounting portion for mounting the sheet locating device to the stapler, the mounting portion being configured to permit rotational movement of the guide member with respect to the stapler, by the user, between desired stapling positions, but configured to substantially prevent rotation of the guide member between stapling positions when the edge of the stack of sheets contacts the guide member, regardless of orientation of the stack of sheets.

22. The sheet locating device of claim 21, wherein the mounting portion comprises a shaft.

23. The sheet locating device of claim 21, further comprising a locking mechanism that substantially prevents rotation of the guide member when the edge of the stack of sheets contacts the guide member in a desired stapling position.

24. The sheet locating device of claim 23, wherein the locking mechanism includes a detent mechanism to retain the guide member in a desired stapling position relative to the mounting portion.

25. The sheet locating device of claim 21, wherein the mounting portion comprises a mounting bracket.

26. The sheet locating device of claim 21, further comprising a second guide member configured to receive a second edge of the stack of sheets, the first and second guide members having respective first and second guide surfaces that are fixed relative to each other.

27. The stapler of claim 21, wherein the stapler includes a base, and wherein the sheet locating device is configured to be coupled to a top surface of the base.

28. The stapler of claim 21, wherein the stapler includes a base, and wherein the sheet locating device is configured to be supported by a top surface of the base.

29. The stapler of claim 21, wherein the sheet locating device is configured to be irremovably fixed to the stapler.

30. A method of stapling using a stapler, the stapler including a staple driving mechanism, a base, and a movable guide member, the method comprising:

positioning the guide member in a first rotational position relative to the staple driving mechanism;

inserting a first stack of sheets into contact with the guide member, the guide member being substantially immovable in response to contact with the first stack of sheets;

actuating the staple driving mechanism to insert a staple into the first stack of sheets in a first rotational orientation relative to the guide member;

removing the first stack of sheets;

moving the guide member to a second rotational position relative to the staple driving mechanism;

after moving the guide member to the second rotational position, inserting a second stack of sheets into contact with the guide member, the guide member being substantially immovable in response to contact with the second stack of sheets; and actuating the staple driving mechanism to insert a staple into the second stack of sheets in a second rotational orientation relative to the guide member.

31. The method of claim 30, wherein inserting the first and second stacks of sheets into contact with the guide member aligns the stacks of sheets with the guide member.

32. The method of claim 30, wherein actuating the staple driving mechanism includes triggering a sensor to electronically activate the staple driving mechanism to insert a staple.

33. The method of claim 30, wherein moving the guide member to the second rotational position includes grasping and rotating the guide member.

34. The method of claim 30, wherein moving the guide member to the second rotational position includes actuating a lever.

35. The method of claim 30, wherein moving the guide member to the second rotational position includes engaging a locking mechanism to substantially secure the guide member in the second rotational position.

36. The method of claim 30, wherein the stapler further includes a second guide member, and wherein moving the first guide member to the second rotational position causes simultaneous motion of both the first and second guide members in the same rotational direction.

37. The method of claim 30, wherein moving the first guide member to the second rotational position includes rotating the first guide member in a plane generally normal to a staple driving direction.

38. A stapler for binding a stack of sheets, the stapler comprising:

a base;

a staple driving mechanism coupled to the base; and a sheet locating device coupled to the base, the sheet locating device having a guide including a first guide member configured to receive a first edge of the stack of sheets and a second guide member configured to receive a second edge of the stack of sheets, the sheet locating device being movable with respect to the staple driving mechanism from a first rotational orientation relative to the staple driving mechanism to a second rotational orientation relative to the staple driving mechanism such that a staple can be driven from the staple driving mechanism in at least two different orientations relative to the stack of sheets;

wherein the first and second guide members each have a guide surface, and wherein the guide surfaces are fixed relative to each other; and wherein the sheet locating device rotates in a plane that is generally normal to a staple driving direction.

39. The stapler of claim 38, wherein the guide surfaces are substantially normal to one another.

40. The stapler of claim 38, wherein the sheet locating device is coupled to a top surface of the base.

41. The stapler of claim 38, wherein the sheet locating device is supported by a top surface of the base.

42. The stapler of claim 38, wherein the sheet locating device is irremovably fixed to the base.

43. A stapler for binding a stack of sheets, the stapler comprising:

a base defining a longitudinal axis;

a staple driving mechanism coupled to the base; and a sheet locating device coupled to the base, the sheet locating device including a guide configured to receive an edge of the stack of sheets, the sheet locating device being movable from a first orientation relative to the staple driving mechanism to a second orientation relative to the staple driving mechanism, such that when moving between the first and second orientations, portions of the guide undergo movement within a plane generally normal to a staple driving direction and in a direction having a component substantially parallel to the longitudinal axis and a component substantially normal to the longitudinal axis;

wherein the guide includes a first guide surface and a second guide surface, the first and second guide surfaces being fixed relative to each other.

44. The stapler of claim 43, wherein the guide surfaces are substantially normal to one another.

45. The stapler of claim 43, wherein the sheet locating device is coupled to a top surface of the base.

46. The stapler of claim 43, wherein the sheet locating device is supported by a top surface of the base.

47. The stapler of claim 43, wherein the sheet locating device is irremovably fixed to the base.

* * * * *